US010777167B2

(12) United States Patent
Bezryadin et al.

(10) Patent No.: US 10,777,167 B2
(45) Date of Patent: Sep. 15, 2020

(54) COLOR IMAGE DISPLAY ADAPTATION TO AMBIENT LIGHT

(71) Applicant: Sergey N. Bezryadin, Aliso Viego, CA (US)

(72) Inventors: Sergey N. Bezryadin, Aliso Viejo, CA (US); Anton Sotnikov, Laguna Hills, CA (US)

(73) Assignee: Sergey N. Bezryadin, Aliso Viego, CA (US)

( * ) Notice: Subject to any disclaimer, the term of this patent is extended or adjusted under 35 U.S.C. 154(b) by 15 days.

(21) Appl. No.: 16/359,730

(22) Filed: Mar. 20, 2019

(65) Prior Publication Data

US 2020/0251069 A1 Aug. 6, 2020

Related U.S. Application Data

(60) Provisional application No. 62/801,425, filed on Feb. 5, 2019.

(51) Int. Cl.
*G09G 5/10* (2006.01)
*G09G 5/06* (2006.01)

(52) U.S. Cl.
CPC ..... *G09G 5/10* (2013.01); *G09G 5/06* (2013.01); *G09G 2320/0242* (2013.01); *G09G 2320/0626* (2013.01); *G09G 2360/144* (2013.01)

(58) Field of Classification Search
None
See application file for complete search history.

(56) References Cited

U.S. PATENT DOCUMENTS

| | | | | |
|---|---|---|---|---|
| 6,760,108 | B2 | 7/2004 | Ohga | |
| 7,489,420 | B2 | 2/2009 | Bezryadin | |
| 7,956,823 | B2 * | 6/2011 | Miyachi | G09G 3/3607 345/690 |
| 8,466,907 | B2 | 6/2013 | Bell | |
| 8,817,002 | B2 | 8/2014 | Robinson et al. | |
| 9,530,342 | B2 | 12/2016 | Bell et al. | |
| 9,947,275 | B1 * | 4/2018 | Ramanath | G09G 3/3413 |
| 10,459,318 | B2 * | 10/2019 | Iwata | G06T 11/001 |
| 2008/0303918 | A1 * | 12/2008 | Keithley | G09G 3/20 348/223.1 |
| 2009/0153888 | A1 * | 6/2009 | Edge | H04N 1/603 358/1.9 |
| 2011/0285763 | A1 * | 11/2011 | Bassi | G09G 3/2003 345/694 |
| 2014/0063039 | A1 * | 3/2014 | Drzaic | G09G 5/02 345/589 |
| 2014/0132578 | A1 | 5/2014 | Zheng | |
| 2014/0204110 | A1 * | 7/2014 | Miki | G09G 3/20 345/589 |
| 2016/0358584 | A1 | 12/2016 | Greenebaum et al. | |
| 2017/0034520 | A1 | 2/2017 | Rosewarne | |
| 2017/0078706 | A1 * | 3/2017 | Van Der Vleuten | G06T 5/009 |
| 2017/0162130 | A1 * | 6/2017 | Ghoshal | H05B 45/22 |
| 2018/0012560 | A1 | 1/2018 | Yuan | |
| 2018/0018925 | A1 * | 1/2018 | Li | G02F 1/133514 |

(Continued)

OTHER PUBLICATIONS

Wyszecki & Stiles, "Color Science" (2nd Ed. 2000), pp. 493-499.

*Primary Examiner* — Ryan M Gray
(74) *Attorney, Agent, or Firm* — Haynes and Boone, LLP

(57) ABSTRACT

Color images are adapted for better viewing in ambient light, especially in the presence of screen glare.

20 Claims, 5 Drawing Sheets

(56) References Cited

U.S. PATENT DOCUMENTS

| | | | | |
|---|---|---|---|---|
| 2018/0040297 | A1 | 2/2018 | Dunn et al. | |
| 2018/0122335 | A1* | 5/2018 | Chen | G09G 5/10 |
| 2018/0144691 | A1* | 5/2018 | Choi | G02F 1/133603 |
| 2018/0367819 | A1* | 12/2018 | Van Der Vleuten | G09G 3/2003 |
| 2019/0014235 | A1 | 1/2019 | Hellier et al. | |

* cited by examiner

COLOR IMAGE DISPLAY ADAPTATION TO AMBIENT LIGHT

CROSS REFERENCE TO RELATED APPLICATIONS

The present application claims priority of U.S. provisional patent application No. 62/801,425, filed 5 Feb. 2019, incorporated herein by reference.

BACKGROUND OF THE INVENTION

The present invention relates to display of color images on mobile phones, computer monitors, and other types of devices, and more particularly to adaption of color images to ambient light.

Displayed images can be hard to see in bright ambient light due to screen glare. FIG. 1 illustrates a human user 110 watching the screen of a mobile phone 120 having a display 130. The images are generated by the display 130 emitting light 140. In addition, the display reflects ambient light 150 generated by ambient light sources 160 such as the sun or office lighting. The reflected light 150R can overpower the display's own light 140, and the user 110 may be unable to clearly see the images, especially dark image areas.

Some self-emissive liquid crystal displays (LCDs) automatically increase their backlight power in response to increased ambient light 150. Specifically, a self-emissive LCD 130 has a backlight source behind the screen. The backlight source emits the light 140 towards user 110. The light passes through liquid crystal cells, whose transmissivity is controlled by electrical signals to form an image. The image can be brightened by increasing the backlight power. In some displays, the backlight power is automatically increased if an ambient light sensor 180 in device 120 senses increased ambient luminance. However, the backlight power cannot be increased indefinitely due to engineering limitations. Therefore, even the maximum backlight power may be insufficient to comfortably see the screen in bright ambient light. Also, power must be conserved in some devices, especially if they are battery-operated. Further, high backlight brightness reduces the dynamic range of the display.

Alternatively, dark images areas can be brightened by making the corresponding pixels more transmissive. See U.S. Pat. No. 9,530,342, issued 27 Dec. 2016 to Bell et al., incorporated herein by reference. The Bell patent proposes modifying the image "dominated by darker tones" by boosting the luminance of darker tones "in proportion to the estimated ambient brightness". This boosting is achieved by "modifying or selecting one or more gamma curves associated with the display" based on the ambient light. A gamma curve "may take the form of a power function". As is well known, a gamma curve may define a transformation of a color coordinate (e.g. red, green, or blue intensity value) before that coordinate is converted to an optical signal by the display. See also U.S. pre-grant patent publication no. 2018/0040297 A1 (applicant: Dunn et al.), incorporated herein by reference.

Alternative image adaptation to ambient light is desirable.

SUMMARY

This section summarizes some features of the invention. Other features may be described in the subsequent sections. The invention is defined by the appended claims, which are incorporated into this section by reference.

The inventor has observed that brightening an image by means of a gamma curve may lead to chromatic changes. Some embodiments of the present invention brighten image areas while minimizing or avoiding chromatic changes. For example, in some embodiments, when the device receives a pixel's color to be displayed, the device first determines the color's brightness parameter. (An example brightness parameter is the maximum value of the primary color intensities, e.g. the maximum of the red, green, and blue intensities.) Then the device obtains a new brightness parameter, representing increased brightness. Then the device determines the new color corresponding to the new brightness parameter but having the same chromaticity as the received color. The device displays the new color. Chromatic changes are therefore avoided in brightness adaptation to ambient light.

However, some embodiments allow for chromatic distortion as a trade-off for speed. Also, chromatic changes can be introduced in other image processing operations, e.g. white balancing (adaption of the image to ambient light chromaticity).

Some embodiments provide fast digital circuitry for adapting the brightness to ambient light as described above. As is well known, fast circuitry can sometimes be obtained by pre-computing all possible outputs and storing them in a look-up table (LUT). Then real-time mathematical operations can be replaced by fetching the result from the LUT. However, pre-computed outputs may require large LUTs, straining the memory requirements and making the LUT look-up slow. In some embodiments of the present invention, the LUTs are of modest size. Further, in some embodiments, the LUTs combine brightness transformations with other color processing, e.g. white balance.

Some embodiments of the present invention can be combined with backlight power adjustment or other techniques used in prior art. However, in some embodiments, no backlight power adjustment is done; the range of brightness values available for the image is unchanged. In some embodiments, the darker image areas are brightened to increase their contrast at the expense of brighter image areas. The dynamic range is unchanged.

The invention is not limited to LCDs, but is applicable to OLEDs (Organic Light-Emitting Diode displays) and other self-emissive displays. Other embodiments and variations are within the scope of the invention, as described below and defined by the appended claims.

DESCRIPTION OF SOME EMBODIMENTS

The embodiments described in this section illustrate but do not limit the invention. The invention is defined by the appended claims.

Figure 2:
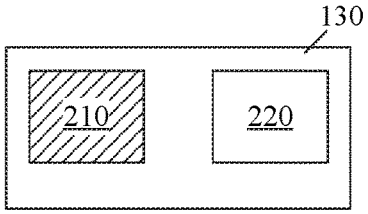
FIG. 2 illustrates a screen with images.

As noted above, some embodiments of the present invention increase the contrast of dark image areas at the expense of bright image areas. FIG. 2 illustrates an image having a dark area 210 and a bright area 220. In some embodiments, when the ambient light is bright, the dark area 210 is increased in contrast, and the bright area 220 is decreased in contrast.

Figure 1:
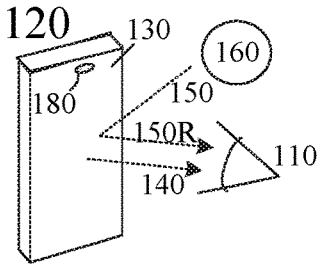
FIG. 1 illustrates a device capable of image processing.
Figure 3A:
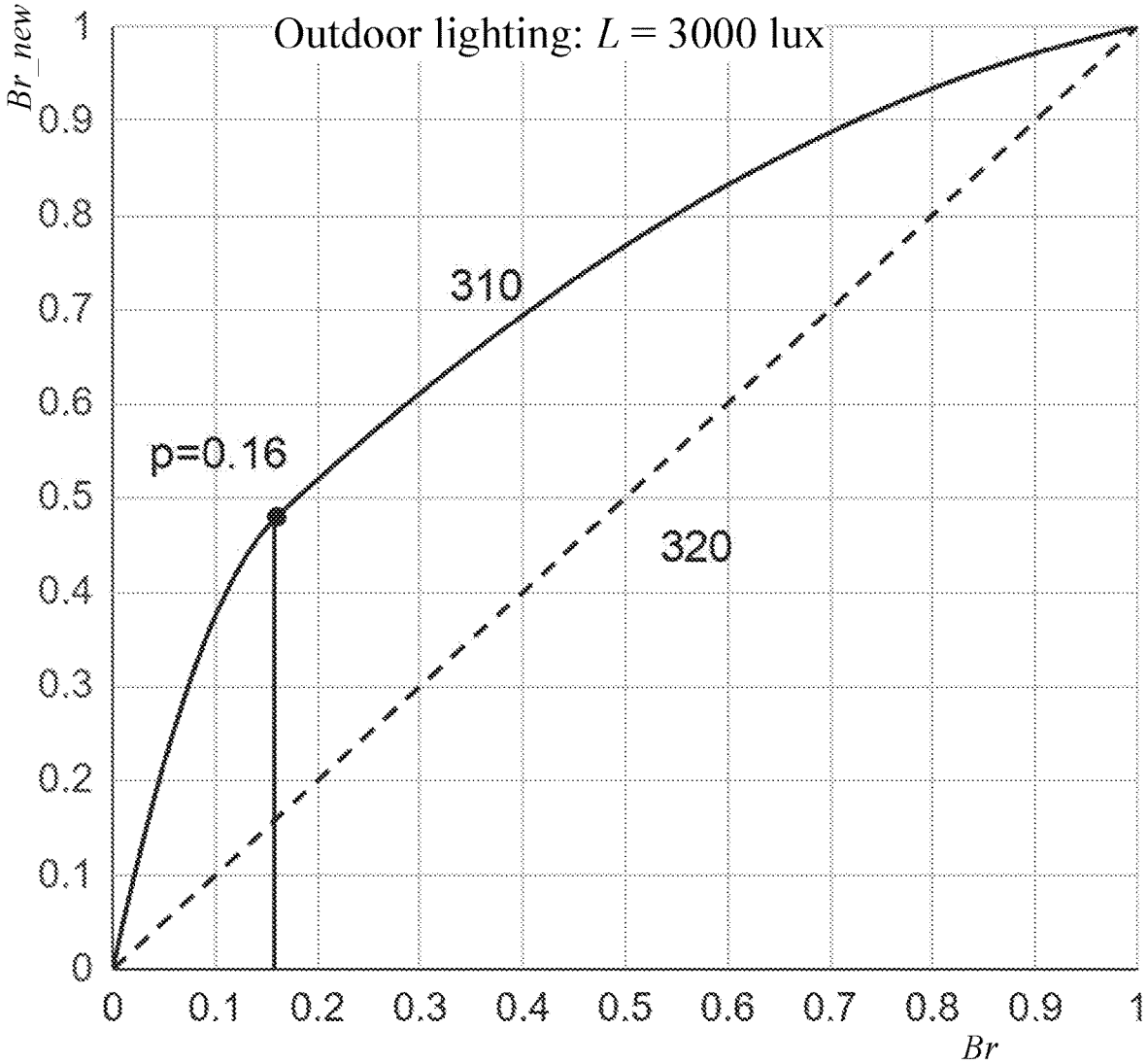
FIGS. 3A, 3B illustrate brightness modification according to some embodiments of the present invention.
Figure 3B:
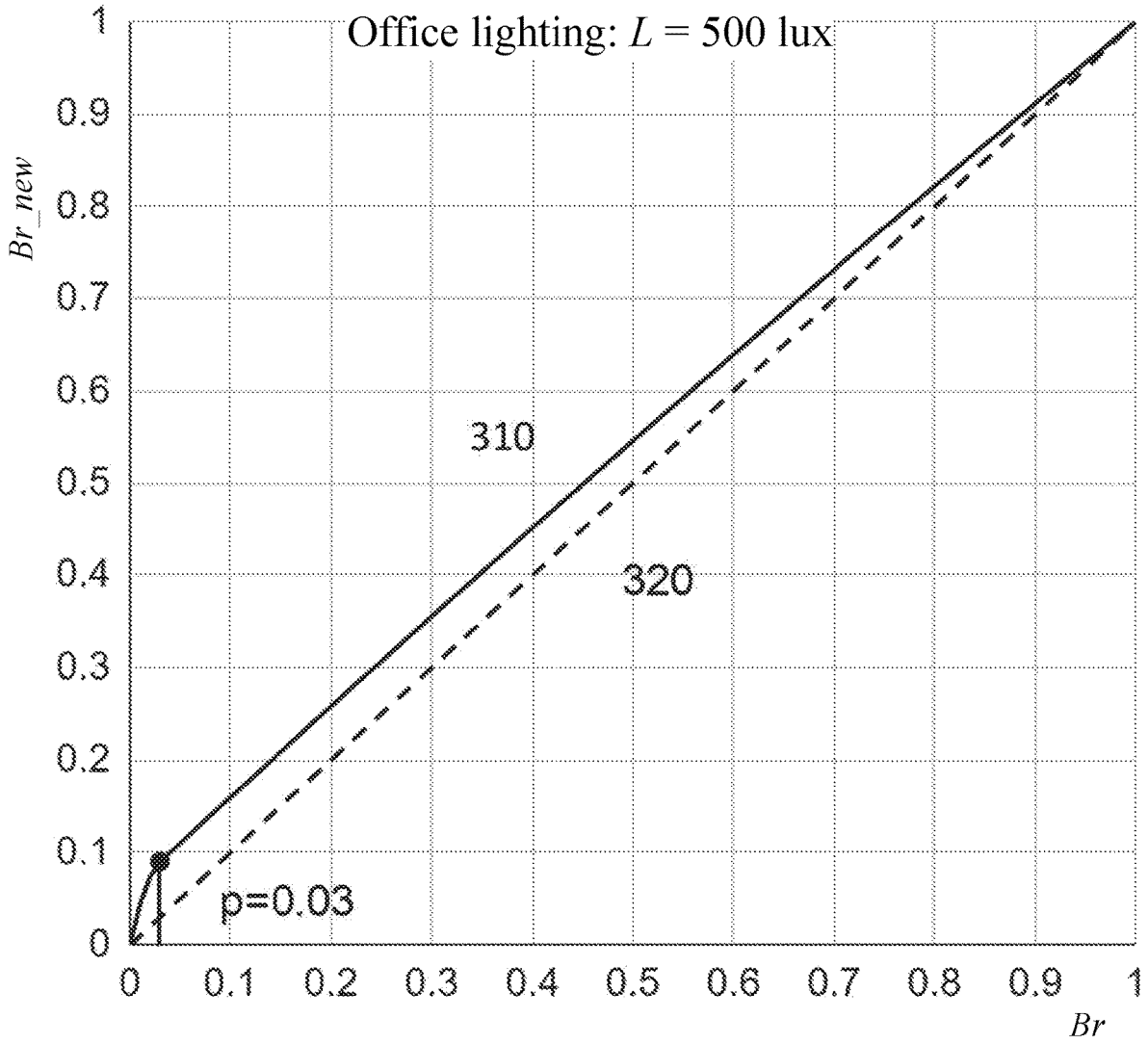

FIGS. 3A, 3B illustrate exemplary graphs of the adjusted brightness Br_new versus the original brightness Br. The "original" brightness refers to the image before the brightness adaptation to ambient light. The brightness adaptation is performed by a processing block 410 (FIG. 4) of a device 120 (FIG. 1) constructed according to some embodiments of the present invention. Block 410 may include hardwired and/or software-programmed circuitry. Block 410 receives the brightness value Br, e.g. a pixel brightness value plotted along the horizontal axis in FIGS. 3A, 3B. Block 410 also receives ambient light luminance L from sensor 180. In addition, block 410 may receive user preference data U provided by the user via manual controls (not shown) of device 120, or in an electronic file, or in some other manner. The user preferences may specify, for example, a preference for increased or decreased brightness of the entire image or of a selected image portion or color. Block 410 outputs modified brightness Br_new, plotted along the vertical axis in FIGS. 3A, 3B. In these figures, the Br and Br_new values are scaled to the range [0,1]. FIG. 3A assumes the ambient light luminance L=3000 lux, common for daytime outdoors. FIG. 3B assumes ambient light luminance L=500 lux, sometimes recommended as the maximum office lighting. In both figures, Br_new is represented by curve 310. Straight line 320 shows unchanged brightness, i.e. for the case Br_new=Br (when block 410 is absent). The operation of block 410 is illustrated by the difference between the lines 310, 320.

Line 320 has the constant slope of 1. In lines 310, the slope is at maximum near Br=0 (darkest image area), where the slope is greater than 1. The slope at each brightness value Br represents the contrast in image areas having brightness about equal to Br. In curves 310, when Br increases, the slope decreases, but remains positive throughout the interval [0,1]. The slope reaches the value of 1 at some point Br=p, and becomes less than 1 for larger Br. The point p is about 0.16 in FIG. 3A, and about 0.03 in FIG. 3B. Thus, in dark image areas (Br<p), the contrast is increased compared to the input image (line 320). In brighter image areas (Br>p) the contrast is decreased. The point p is greater for larger L values, i.e. for stronger ambient light, because when the ambient light is strong then even fairly bright image features become difficult to see and need contrast increase.

The point p may also depend on the screen's reflection coefficient, and is greater for screens with a greater reflection coefficient.

The invention is not limited to the examples described above, and in particular is not limited to any slope values or brightness definition. Regarding brightness definition, brightness can be defined as the maximum primary color coordinate in some color coordinate system (color space), e.g. sRGB or linear RGB. Other brightness definitions include Luma in the ITU-R BT.601 standard, Value in the HSV model, and other definitions provided, for example, in U.S. Pat. No. 7,489,420 B2 (inventor: Sergey N. Bezryadin), issued Feb. 10, 2009, incorporated herein by reference; Wyszecki & Stiles, "Color Science" ($2^{nd}$ Ed. 2000), pp. 493-499, incorporated herein by reference. Other definitions are also possible.

Further, in some embodiments, the image transformation performed by circuit 410 is combined with other types of image processing, e.g. white color balance or backlight adjustment.

Figure 4:
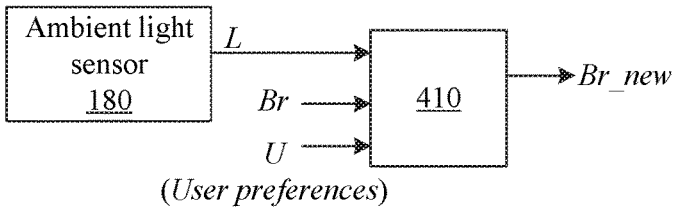
FIG. 4 illustrates a brightness modification block according to some embodiments of the present invention.
Figure 5:
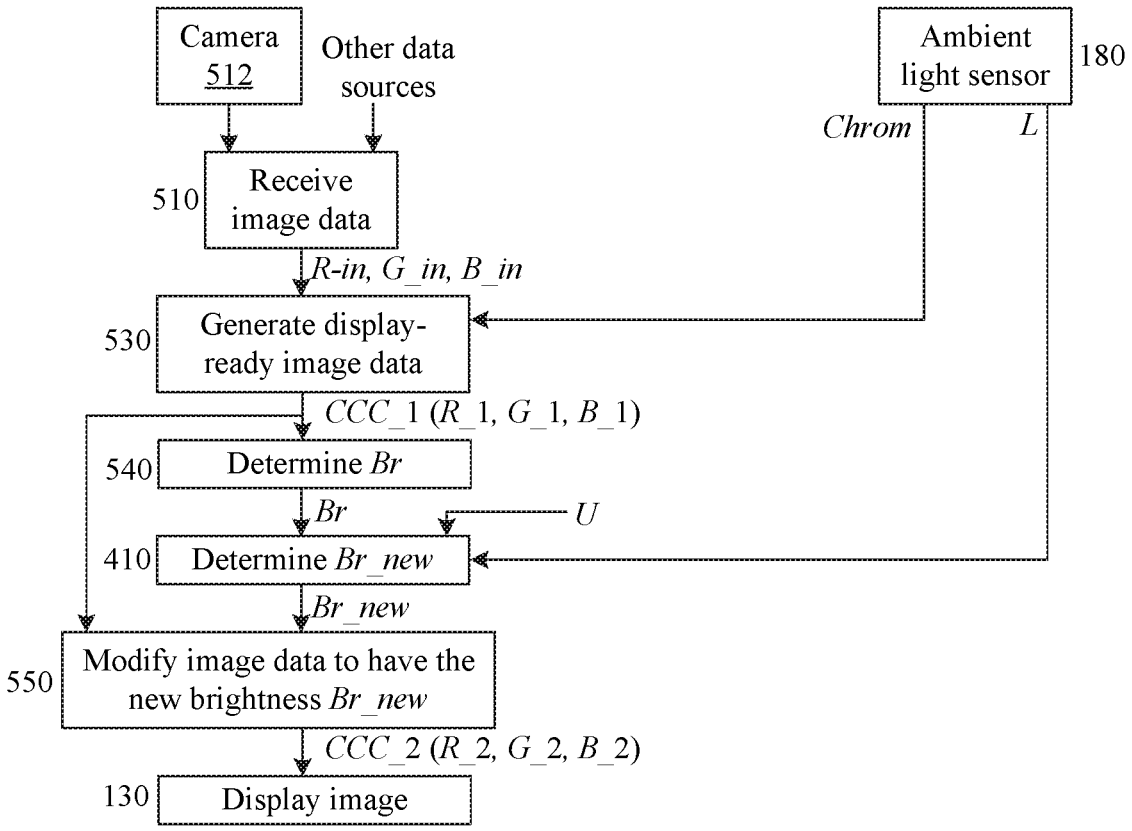
FIG. 5 illustrates digital image processing according to some embodiments of the present invention.

FIG. 5 illustrates exemplary image processing by a device 120 constructed according to some embodiments of the present invention, and in particular incorporating the block 410 of FIG. 4. FIG. 5 illustrates a sequence of steps each of which is performed by a corresponding function block of device 120. Each function block includes hardwired and/or software programmed circuits or other devices. Different function blocks can share components.

Block 510 receives image data representing an image to be displayed. The image data may come from a camera 512 built into or attached to device 120, or from other sources, e.g. a network (possibly the Internet), or a computer storage in device 120 (e.g. flash memory or some other type), or some other source. The image data are digital data. The operation 510 can be performed as in the Dunn et al. reference cited above. In an exemplary embodiment, the data is in sRGB or linear RGB format, with (linear or non-linear) RGB coordinates shown as R_in, G_in, B_in, but any suitable format can be used.

Ambient light sensor 180 of device 120 senses ambient light 150, and generates chromaticity data Chrom and luminance data L. In some embodiments, the chromaticity data Chrom are the x, y coordinates of the CIE xyY color coordinate system. Other chromaticity representations are also possible. Sensor 180 may make several measurements per second; see Dunn et al. The measurements may be filtered (smoothened, e.g. averaged) to reduce noise.

Block 530 of device 120 receives the "C_in" data from block 510, i.e. the values R_in, G_in, B_in. (We use the letter C as a generic coordinate; thus, in an RGB color coordinate system, C_in indicates any one of R_in, G_in, B_in.) Block 530 generates a display-ready image, possibly (though not necessarily) as in Bell et al. Step 530 may or may not include white color balancing based on chromaticity values Chrom provided by sensor 180. A display-ready image color generated by block 530 for a single pixel is shown as CCC_1, with RGB coordinates R_1, G_1, B_1. The RGB color coordinate system is used for illustration only; other color coordinate systems are possible.

In block 540, for each color CCC_1, its brightness Br is determined using any suitable brightness definition as described above. The brightness Br, the luminance L, and user preferences U if any, are provided to block 410.

Block 410 determines the new brightness Br_new as described above or below.

Block 550 receives from block 530, for each pixel, the color CCC_1 coordinates such as R_1, G_1,B_1, and receives the corresponding brightness Br_new from block 410. Block 540 determines and outputs the new color CCC_2, with coordinates (R_2, G_2, B_2), having the same chromaticity as CCC_1 but having brightness Br_new. For example, block 550 may determine tristimulus values of color CCC_1, and multiply them by the ratio Br_new/Br. Tristimulus values are color coordinates in a linear color coordinate system.

Display 130 receives the CCC_2 coordinates from block 550 and displays the color CCC_2 at the corresponding pixel(s).

In FIG. 5, different steps may overlap: a block can operate on one pixel or color while other blocks operate on other pixels or colors. In some embodiments, the device displays a sequence of images in rapid succession, e.g. as a video, but the values L and Chrom remain constant throughout rendering of a given image (e.g. a video frame). In other embodiments, the L and/or Chrom values can change while displaying a single image.

Figure 6:
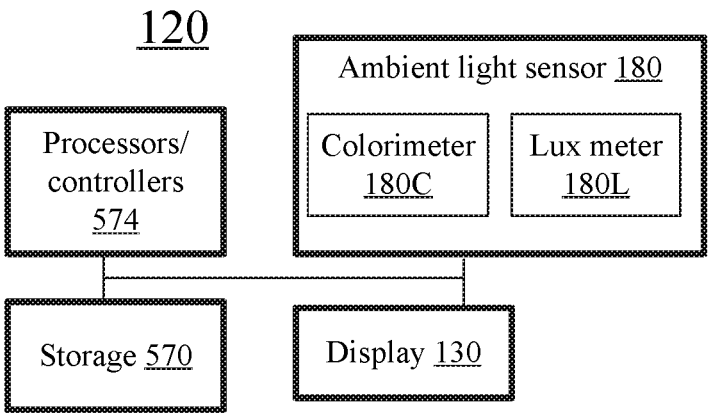
FIG. 6 is a block diagram of an image processing device according to some embodiments of the present invention.

Many variations are possible. For example, in sensor 180, the luminance L can be smoothened by a low pass filter to eliminate noise as stated above, and also to slow down the L transitions to match the rate of adaption of human vision to ambient luminance changes. In the example of FIG. 6, sensor 180 includes a lux meter 180L which records the ambient light luminance Lux, and determines the filtered luminance L as follows:

$$L=L*(1-A)+A*Lux \tag{1}$$

where L is initialized to 100, and A is some constant, e.g. A=0.1. Other A values and initial L value can be used, and other types of filtering are possible.

In one example, block 410 determines Br_new as follows:

$$\text{Br_new}=f_p(\text{Br}) \tag{2}$$

where f_p(Br) is a suitable function, e.g. defining the upper curve 310 in FIG. 3A or 3B. For example, in some embodiments, f_p is a family of functions parameterized by a value p dependent on L. In some embodiments, $$p=\frac{Ref}{M}*L \tag{3}$$

where L is given by equation (1); Ref is the reflection coefficient of the screen of display 130; and M is the maximum luminance that can be generated by display 130.

Further, in some embodiments, parameter p is clipped not to exceed a predefined maximum value p_0:

$$p=\min(p,p_0) \tag{4}$$

In some embodiments, p_0=⅙.

For each value p, the corresponding function f_p(x) is an increasing function. Its slope (i.e. the derivative η_p'=d(Br_new)/d(Br)) is equal to 1 at x=p:

$$f_p'(p)=1$$

$$f_p'(x)>1 \text{ for } x<p$$

$$f_p'(x)<1 \text{ for } x>p \tag{5}$$

See the discussion of FIGS. 3A, 3B above. In some embodiments, the slope is strictly or non-strictly decreasing. For example:

$$f_p(x)=ax^2+bx \text{ for } x\le p \tag{6A}$$

$$f_p(x)=a*x^2+b*x+c \text{ for } x>p \tag{6B}$$

where a, b, and c are constants, possibly having have different values in (6A) than in (6B). The constant a is negative in both (6A) and (6B). In one example:

$$f_p(x)=-(2/p)*x^2+5*x \text{ for } x<p$$

$$f_p(x)=(-p*2(1-p)^2)*x^2+(1+(4*p^2)/(1-p)^2)*x+(2*p-4*p^2)/(1-p)^2 \text{ for } x>p \tag{7}$$

These examples are not limiting.

FIG. 6 is a block diagram of a device 120, which may include a mobile phone, a computer, or any other device capable of digital image processing. The device may include a computer storage 570 (semiconductor, optical, magnetic, or some other kind) that can store image data and/or other digital data, and can store computer instructions and configuration parameters for execution by, and configuring of, processors/controllers 574. Processors/controllers 574 may include one or more computer processors and/or other controllers, e.g. video controllers for controlling display 130. One or more of the processors or controllers 574, and some of storage 570, may be part of display 130 or image sensor 180. One or more of these components may be shared by different function blocks of FIG. 5. Also, one or more of these components may be not shared but dedicated to a single function block.

Ambient light sensor 180 includes lux meter 180L described above, and a colorimeter 180C for generating the digital chromaticity data Chrom. The sensor 180 may include opto-electrical transducers (not shown) for generating and digitizing ambient light signals. Each of colorimeter 180C and lux meter 180L may include computer processors, controllers, and computer storage, to perform filtering as mentioned above.

Figure 7:
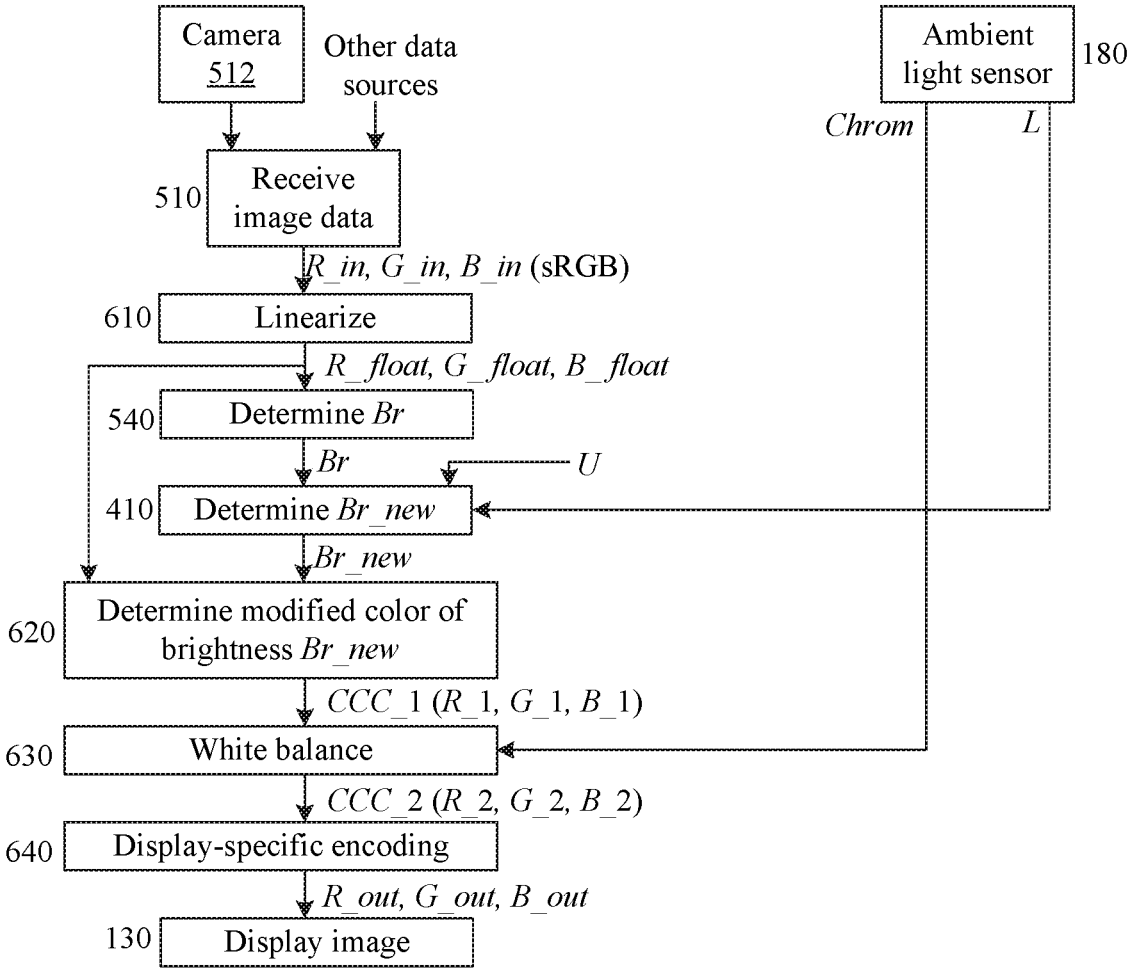
FIGS. 7 and 8 illustrate digital image processing according to some embodiments of the present invention.

FIG. 7 illustrates another image processing scheme for a device 120 of the type shown in FIG. 6. Some operations of FIG. 7 are similar to FIG. 5, but brightness adjustment (block 410) is performed before white balancing color adaptation. Block 510 (image reception) is as in FIG. 5. For the sake of illustration, it is assumed below that the image data received in block 510 can be in sRGB format, with each primary color intensity C_in (red, green, blue) represented by an 8-bit, 10-bit, or 12-bit integer. The primary color intensity is therefore in the respective range from 0 to 255, or from 0 to 1023, or from 0 to 4095 (inclusive). But the processing of FIG. 7 is not limited to any particular color representation or intensity range except as noted below.

Block 610 converts the C_in coordinates to a linear color coordinate system, e.g. linear RGB, possibly in floating point format. The resulting coordinates (tristimulus values) are shown as (R_float, G_float, B_float).

Block 540 determines brightness Br for each pixel, using any technique described above. The brightness can be calculated based on the C_in coordinates, or the linear C_float coordinates, or both. In some embodiments:

$$\text{Br}=\max(R_\text{float},G_\text{float},B_\text{float}) \tag{8}$$

Ambient light sensor 180 and block 410 operate as in FIG. 5. In some embodiments, block 410 determines the brightness Br_new as in equation (2) above, i.e.:

$$\text{Br_new}=f_p(\text{Br})$$

Block 620 calculates the new, linear color coordinates (R_1, G_1, B_1) for a color CCC_1 having the same chromaticity as the C_float color but having the brightness Br_new:

$$K=\text{Br_new}/\text{Br}$$

$$C_1=C_\text{float}*K \tag{9}$$

Block 630 receives the Chrom data (possibly the x, y values of the CIE xyY color coordinate system) from sensor 180, and white-balances the CCC_1 color using a suitable transformation matrix T determined based on the Chrom data. The output of block 630 is a color CCC_2 with coordinates C_2:

$$\begin{pmatrix}\text{R_2}\\ \text{G_2}\\ \text{B_2}\end{pmatrix}=T\begin{pmatrix}\text{R_1}\\ \text{G_1}\\ \text{B_1}\end{pmatrix} \tag{10}$$

In some embodiments, colorimeter 180C determines the Chrom values several times per second and stores them as historical data. These Chrom values are adjusted based on a trend calculated from the historical data, and are averaged to filter out noise, before being used to calculate the matrix T.

The matrix T can be calculated in a conventional way, based on a known color model, e.g. Von Kries or Bradford model. See for example U.S. Pat. No. 6,760,108, issued to Ohga on Jul. 6, 2004, incorporated herein by reference; U.S. pre-grant patent publication no. 2009/0153888 A1 (inventor: Edge), published Jun. 18, 2009, incorporated herein by reference. Matrix T can be calculated by sensor 180 or other circuitry.

The white-balanced color CCC_2 is encoded by block 640 based on the display 130 characteristics, to obtain the encoded values C_out. For example, if the display has a gamma value "gamma", and accepts 8-bit integer color coordinates, then block 640 calculates:

$$C_out=(C_2)^{(1/gamma)}*255 \tag{11}$$

where each C_out is rounded to the nearest integer. Multiplication by 255 is performed to convert to integer format, and is not shown in some equations below.

The C_out values are provided to display 130.

Fast Processing with LUTs

At least some of the image processing schemes described above can be speeded up by LUTs.

Brightness LUT: InputToLinear

Linearize function 610 can be slow. For example, if the C_in data are in sRGB format, and the C_float data are in linear RGB format, then the linearization may involve exponentiation with a fractional exponent, and this operation is relatively slow on many computer processors. This operation can be speeded up by using a LUT.

Suppose, as is the case of color conversion from sRGB to linear RGB, the linearization can be performed using the same function for each C coordinate (red, green, blue) independently of the other coordinates:

$$C_float=\text{InputToLinear}(C_in) \tag{12}$$

where InputToLinear is some function, the same for each C. In such cases, the InputToLinear values can be precomputed for all possible C_in values, and stored in a LUT usable for all C. For example, if each C_in is an integer from 0 to 255 inclusive, then the LUT will have 256 values InputToLinear[i], where i is an integer varying from 0 to 255 inclusive.

Further, suppose that the brightness Br is defined by equation (8), i.e. the maximum of the C_float values. Then Br can be determined by first finding the maximum C_in, then fetching the corresponding C_float value from InputToLinear:

$$\text{Br_in}=\max(R_in,G_in,B_in)$$

$$\text{Br}=\text{InputToLinear}[\text{Br_in}] \tag{13}$$

White-Balancing LUTs

In some color models. the matrix T is diagonal:

$$T=\begin{pmatrix} \text{T_R} & 0 & 0 \\ 0 & \text{T_G} & 0 \\ 0 & 0 & \text{T_B} \end{pmatrix}$$

where each T_C, i.e. each of T_R, T_G, T_B, depends on the ambient light chromaticity Chrom, and possibly luminance L. In such cases, equation (10) becomes:

$$\begin{pmatrix} \text{R_2} \\ \text{G_2} \\ \text{B_2} \end{pmatrix}=\begin{pmatrix} \text{T_R}*\text{R_1} \\ \text{T_G}*\text{G_1} \\ \text{T_B}*\text{B_1} \end{pmatrix} \tag{14}$$

or $$C_2=T_C*C_1$$

Equation (11) becomes:

$$C_out=(T_C*C_1)^{(1/gamma)}*255 \tag{15}$$

Multiplication by 255 represents conversion to an integer in the range from 0 to 255 inclusive if the C_out values are in this range. If the C_out values can be in another range, a suitable conversion is performed as need. Therefore, this multiplication is not shown in some equations below.

From equations (9) and (15), it follows that:

$$C_out=(T_C*K)^{(1/gamma)}*(C_float)^{(1/gamma)} \tag{16}$$

Let us denote the first term in this equation as K_C:

$$K_C=(T_C*K)^{(1/gamma)} \tag{17}$$

Per equations (2) and (9), this term can be written as:

$$K_C=(T_C*f_p(\text{Br})/\text{Br})^{(1/gamma)} \tag{18}$$

The possible Br values can be pre-computed as InputToLinear[i] per equations (13). Therefore, the K_C values can also be pre-computed for each i. Some embodiments use a separate K_C[i] LUT for each C value of R, G, and B (three K_C LUTs total). The LUTs are:

$$K_C[i]=(T_C*f_p(x)/x)^{(1/gamma)} \tag{19}$$

where $$x=\text{InputToLinear}[i]$$

and i varies over the same range as each C_in (e.g. 0 to 255). Then, in real-time during image processing, the K_C values in (17) can be obtained from the K_C LUTs as follows:

$$\text{Br_in}=\max(R_in,G_in,B_in)$$

$$K_C=K_C[\text{Br_in}] \tag{20}$$

Figure 8:
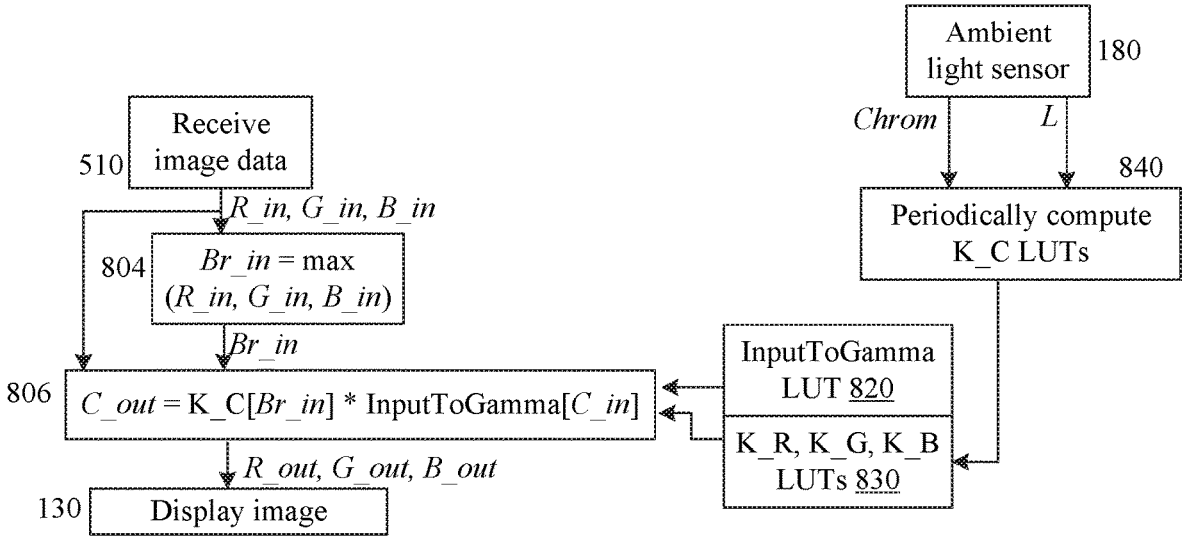

In equations (18) and (19), the T_C values depend on ambient light parameter Chrom (and possibly L). Therefore, the K_C LUTs are periodically re-computed, possibly every few seconds, based on the recent Chrom and L values. See FIG. 8, block 840. FIG. 8 is discussed below.

Gamma LUT: InputToGamma

The second term in equation (16) is:

$$(C_float)^{(1/gamma)} \tag{21}$$

This term can be computed as:

$$(C_float)^{(1/gamma)}=(\text{InputToLinear}[C_in])^{(1/gamma)} \tag{22}$$

Some embodiments pre-compute the values (22), and store them in the following LUT:

$$\text{InputToGamma}[i]=(\text{InputToLinear}[i])^{(1/gamma)} \tag{23}$$

where i varies over the same range as each C_in.

The InputToGamma LUT can be stored in integer or floating point format.

The above optimization techniques can be used separately, or can be combined as shown in FIG. 8. In particular, the C_out values (16) can be determined from C_in by the following computations—see equations (17), (20), (22), (23):

$$\text{Br_in}=\max(R_in,G_in,B_in) \tag{24A}$$

$$C_out=K_C[Br_in]*InputToGamma[C_in] \quad (24B)$$

This image processing is shown in FIG. 8. Operations (24A), (24B) are performed in respective blocks 804, 806. Block 806 gets InputToGamma values from LUT 820, and K_C values from LUTs 830. LUTs 820, 830 are stored in storage 570 (FIG. 6). LUT 820 is pre-computed at system initialization (possibly at manufacturing time), or some other time, and LUTs 830 are periodically computed by block 840. Blocks 804, 806 perform the function of blocks 610, 540, 410, 620, 630, and 640 of FIG. 7.

Other uses of LUTs are possible. For example, the InputToLinear LUTs can be different for different C coordinates. Other variations are also possible.

Additional Optimization Techniques

Omit White Balance

Some embodiments omit white balancing. In equations (15)-(19), T_C is omitted. Also, some embodiments do not generate the Chrom values.

In such embodiments, the K_C values are independent of C, and can be stored in a single LUT K[i] for all C:

$$K[i]=(f_p(x)/x)^{(1/gamma)} \quad (25)$$

where x depends on i as described above for K_C.

In real time, in equation (24B), K_C[Br_in] is replaced by K[Br_in].

Omit Brightness Computation, with Some Chromatic Distortion

In this variation, equation (24A) is omitted. In equation (24B), Br_in is replaced by C_in. Therefore, equations (24A) and (24B) are replaced by:

$$C_out=K_C[C_in]*InputToGamma[C_in] \quad (26)$$

Chromatic distortion may occur in this case.

In some embodiments, the C_out values (26) are pre-computed as a single LUT for each C coordinate. Thus (see equation (19)), the three K_C LUTs are replaced respectively with the following LUTs:

$$K_C'[i]=(T_C*f_p(x)/x)^{(1/gamma)}*InputToGamma[i] \quad (27)$$

where x and i are as in (19). Then in real time:

$$C_out=K_C'[C_in] \quad (28)$$

In some embodiments, block 804 can be omitted, and block 806 determines each C_out from the K_C' LUT per equation (28).

Omit Brightness Computation and White Balancing

If brightness computation is omitted as described above for equation (26), and white balancing is omitted as described above for equation (25), then the following LUT can be used in (28) instead of K_C':

$$K'[i]=(f_p(x)/x)^{(1/gamma)}*InputToGamma[i]$$

Then operation 806 is reduced to a look-up of K'[C_in] for each C:

$$C_out=K'[C_in]$$

The invention is not limited to the embodiments described above. In particular, the use of LUTs is not limited to the cases when all C_in vary in the same range, or to other assumptions above. Some embodiments of the invention are defined by the following clauses.

Clause 1 defines a method for digital image processing, the method comprising:

obtaining, by an image processing system, first image data representing a first color image (the first image data could, for example, be C_in or C_1 in FIG. 5, or C_in or C_float in FIG. 7);

obtaining, by the image processing system, ambient-light data (e.g., L) incorporating information on a luminance of ambient light; and processing the first image data by the image processing system, said processing incorporating a brightness transformation which corresponds to multiplying color coordinates (e.g. C_in or C_float), in a first color coordinate system (e.g. sRGB or RGB), of each color of one or more colors of an image data (e.g. C_in or C_float) obtained from the first image data, by respective coefficients (e.g. K) associated with the color coordinates, the coefficients being greater than or equal to 1;

wherein for each value of the ambient-light data and for each color coordinate, each coefficient is equal to a ratio of (i) a value of a first function (e.g. f_p) associated with the ambient-light data on a brightness parameter (e.g. Br or, in case of chromatic distortion in equation (26), C_in) associated with the color coordinate, to (ii) the brightness parameter itself, wherein the first function is an increasing function of the brightness parameter, the first function being strictly increasing at least in a range that includes a plurality of brightness parameter values including the lowest possible brightness parameter value, the ratio being greater than 1 for any brightness parameter value within said range. (The range may depend on the ambient light-data.)

2. The method of clause 1, wherein a slope of each first function is a decreasing function of the brightness parameter. (In other words, the slope is a non-increasing function of the brightness parameter, and assumes different values for at least two values of the brightness parameter. The slope can be the derivative or its digital approximation.)

3. The method of clause 2, wherein the decreasing function assumes values both above and below 1 depending on the brightness parameter.

4. The method of clause 2 or 3, wherein each value of the ambient-light data is associated with a predefined value (e.g. p) for which the slope of the associated first function is greater than 1 for any brightness parameter value less than the predefined value, and the slope of the associated first function is less than 1 for any brightness parameter value greater than the predefined value;

wherein the predefined value is an increasing function of the luminance of the ambient-light data, and is strictly increasing on a plurality of luminance values (e.g. equation (3) or (4)).

5. The method of any preceding clause wherein the first color coordinate system is a linear color coordinate system (e.g. RGB).

6. The method of any preceding clause, wherein for each color, the brightness parameter is the same for each color coordinate (e.g. per equation (8)—the maximum value of the color coordinates is the brightness parameter used for each C_1 in equation (9)).

7. The method of any preceding clause, wherein for each color, the brightness parameter is a maximum tristimulus value in a linear color coordinate system in which each tristimulus value represents an intensity of a primary color (e.g. RGB).

8. The method of any preceding clause, wherein said processing of the image data further incorporates a white balancing transformation.

9. The method of clause 8, wherein said processing of the image data comprises a sequence of image transformations including the brightness transformation and the white balancing transformation, each subsequent transformation in the sequence being performed on an output image of the immediately preceding transformation in the sequence, and the brightness transformation precedes the white balancing transformation in the sequence.

10. The method of clause 8, wherein said processing of the image data comprises a sequence of image transformations including the brightness transformation and the white balancing transformation, each subsequent transformation in the sequence being performed on an output image of the immediately preceding transformation in the sequence, and the brightness transformation succeeds the white balancing transformation in the sequence.

11. The method of clause 8, wherein the brightness transformation and the white balancing transformation are accomplished using a look-up table stored in a computer storage of the image processing system.

12. The method of clause 8, wherein the sequence of the transformations is accomplished by a single look-up in a look-up table stored in a computer storage of the image processing system (e.g. equation (28)).

13. The method of any preceding clause, wherein the brightness transformation is performed on every color of the image data obtained from the first image data.

14. The method of any preceding clause, further comprising displaying an output image of the processing of the first image data on a display device.

The invention also comprises systems (e.g. device 120) configured for performing any of the methods described above. The invention comprises computer readable media with computer programs operable to program computer processor(s) and/or controller(s) to perform the methods described above. Other embodiments and variations are within the scope of the invention, as defined by the appended claims.

The invention claimed is:

1. A method for digital image processing, the method comprising:

obtaining, by an image processing system, first image data representing a first color image;

obtaining, by the image processing system, ambient-light data incorporating information on a luminance of ambient light; and processing the first image data by the image processing system, said processing incorporating a brightness transformation which corresponds to multiplying color coordinates, in a first color coordinate system, of each color of one or more colors of an image data obtained from the first image data, by respective coefficients associated with the color coordinates, the coefficients being greater than or equal to 1;

wherein for each value of the ambient-light data and for each color coordinate, each coefficient is equal to a ratio of (i) a value of a first function associated with the ambient-light data on a brightness parameter associated with the color coordinate, to (ii) the brightness parameter itself, wherein the first function is an increasing function of the brightness parameter, the first function being strictly increasing at least in a range that includes a plurality of brightness parameter values including the lowest possible brightness parameter value, the ratio being greater than 1 for any brightness parameter value within said range.

2. The method of claim 1, wherein a slope of each first function is a decreasing function of the brightness parameter.

3. The method of claim 2, wherein the decreasing function assumes values both above and below 1 depending on the brightness parameter.

4. The method of claim 2, wherein each value of the ambient-light data is associated with a predefined value for which the slope of the associated first function is greater than 1 for any brightness parameter value less than the predefined value, and the slope of the associated first function is less than 1 for any brightness parameter value greater than the predefined value;

wherein the predefined value is an increasing function of the luminance of the ambient-light data, and is strictly increasing on a plurality of luminance values.

5. The method of claim 1 wherein the first color coordinate system is a linear color coordinate system.

6. The method of claim 1, wherein for each color, the brightness parameter is the same for each color coordinate.

7. The method of claim 1, wherein for each color, the brightness parameter is a maximum tristimulus value in a linear color coordinate system in which each tristimulus value represents an intensity of a primary color.

8. The method of claim 1, wherein said processing of the image data further incorporates a white balancing transformation.

9. The method of claim 8, wherein said processing of the image data comprises a sequence of image transformations including the brightness transformation and the white balancing transformation, each subsequent transformation in the sequence being performed on an output image of the immediately preceding transformation in the sequence, and the brightness transformation precedes the white balancing transformation in the sequence.

10. The method of claim 8, wherein said processing of the image data comprises a sequence of image transformations including the brightness transformation and the white balancing transformation, each subsequent transformation in the sequence being performed on an output image of the immediately preceding transformation in the sequence, and the brightness transformation succeeds the white balancing transformation in the sequence.

11. The method of claim 8, wherein the brightness transformation and the white balancing transformation are accomplished using a look-up table stored in a computer storage of the image processing system.

12. The method of claim 8, wherein the sequence of the transformations is accomplished by a single look-up in a look-up table stored in a computer storage of the image processing system.

13. The method of claim 1, wherein the brightness transformation is performed on every color of the image data obtained from the first image data.

14. The method of claim 1, further comprising displaying an output image of the processing of the first image data on a display device.

15. A digital image processing system comprising digital circuitry for:

obtaining, by an image processing system, first image data representing a first color image;

obtaining, by the image processing system, ambient-light data incorporating information on a luminance of ambient light; and processing the first image data by the image processing system, said processing incorporating a brightness transformation which corresponds to multiplying color coordinates, in a first color coordinate system, of each color of one or more colors of an image data obtained from the first image data, by respective coefficients associated with the color coordinates, the coefficients being greater than or equal to 1;

wherein for each value of the ambient-light data and for each color coordinate, each coefficient is equal to a ratio of (i) a value of a first function associated with the ambient-light data on a brightness parameter associated with the color coordinate, to (ii) the brightness parameter itself, wherein the first function is an increasing function of the brightness parameter, the first function being strictly increasing at least in a range that includes a plurality of brightness parameter values including the lowest possible brightness parameter value, the ratio being greater than 1 for any brightness parameter value within said range.

16. The system of claim 15, wherein a slope of each first function is a decreasing function of the brightness parameter.

17. The system of claim 16, wherein each value of the ambient-light data is associated with a predefined value for which the slope of the associated first function is greater than 1 for any brightness parameter value less than the predefined value, and the slope of the associated first function is less than 1 for any brightness parameter value greater than the predefined value;

wherein the predefined value is an increasing function of the luminance of the ambient-light data, and is strictly increasing on a plurality of luminance values.

18. The system of claim 15 wherein the first color coordinate system is a linear color coordinate system.

19. The system of claim 15, wherein for each color, the brightness parameter is the same for each color coordinate.

20. The system of claim 15, wherein said processing of the image data further incorporates a white balancing transformation.

* * * * *